US011344781B2

(12) United States Patent
Bernis

(10) Patent No.: US 11,344,781 B2
(45) Date of Patent: May 31, 2022

(54) ROPE TAG FIGHTING

(71) Applicant: Elizaldy Salveron Bernis, Las Vegas, NV (US)

(72) Inventor: Elizaldy Salveron Bernis, Las Vegas, NV (US)

( * ) Notice: Subject to any disclaimer, the term of this patent is extended or adjusted under 35 U.S.C. 154(b) by 234 days.

(21) Appl. No.: 16/677,131

(22) Filed: Nov. 7, 2019

(65) Prior Publication Data

US 2021/0138328 A1 May 13, 2021

(51) Int. Cl.
*A63B 69/00* (2006.01)
*A63B 21/28* (2006.01)

(52) U.S. Cl.
CPC ..... *A63B 69/004* (2013.01); *A63B 21/28* (2013.01); *A63B 2244/10* (2013.01)

(58) Field of Classification Search
CPC ... A63B 69/004; A63B 21/28; A63B 2244/10; A63B 69/20–345; A63B 2069/0042–0044; A63B 23/129; A63B 21/00185; A63B 21/285
USPC ..... 273/440.1, 451, 452; 463/47.5; 70/16; 473/576
See application file for complete search history.

(56) References Cited

U.S. PATENT DOCUMENTS 4,039,185 A * 8/1977 Rhodes ..... A63B 21/28 273/451
4,153,245 A * 5/1979 McCoy ..... A63B 21/28 273/451
4,211,402 A * 7/1980 Carroll ..... A63B 21/28 273/451
5,846,171 A * 12/1998 Hollowell ..... A63B 21/28 482/148
7,854,692 B2 * 12/2010 Prstojevich ..... A63B 21/28 482/91
2004/0082445 A1 * 4/2004 Zabel ..... A63B 21/28 482/109
2011/0224030 A1 * 9/2011 Henzie ..... A63B 43/02 473/470
2021/0138328 A1 * 5/2021 Bernis ..... A63B 69/004

OTHER PUBLICATIONS

Tug of War Jiu Jitsu "https://ms-my.facebook.com/SparBJJ/videos/tug-of-war-belt-battle-warm-ups/2514792771899529/" May 30, 2019 (Year: 2019).*
Martial Arts Games "https://pawma.org/Martial-Arts-Games" 2019 (Year: 2019).*

* cited by examiner

*Primary Examiner* — Nyca T Nguyen

(57) ABSTRACT

Disclosed is a method of playing rope tag fighting game which involves holding a rope by two fighters, wherein each fighter can hold the rope using any one hand and the other hand of each fighter is left free. A first-round of game is played by striking a fighter by opponent fighter using free hand and vice versa while holding the rope. The winner of the first-round is decided. The first-round winner decides which hands of two fighters to hold the rope prior to begin the second-round. The fighters shall use wrestling or kick boxing skills to win second-round. The second-round winner is the fighter that did not lose the rope while striking each other. The fighters must hold the rope, for third-round, using free hands of second-round and the winner of the game is decided by choosing best player of the three rounds.

6 Claims, 3 Drawing Sheets

ROPE TAG FIGHTING

CROSS-REFERENCE TO RELATED APPLICATIONS

This application claims priority to and the benefit of the provisional patent application titled "Rope Tag Fighting", application No. 62/766,875, filed in the United States Patent and Trademark Office on Nov. 7, 2018. The specification of the above referenced patent application is incorporated herein by reference in its entirety.

TECHNICAL FIELD OF THE UTILITY MODEL

The present utility model relates to a combat physical contact sport and more particularly relates to a method of playing rope tag fighting game.

BACKGROUND

The best and most effective martial arts may always arguably be a distant fighting, also referred to as boxing, ground fighting, also referred to as wrestling or jui jitsu, kick boxing, muay thai and karate, judo or tae kwon do. A boxer can only be an effective striker if he/she is away from the opponent most of the time. So, a wrestler or jui jitsu would always have an advantage once the fight is taken to the ground. But there is a need for a game that would make the fighter, such as a wrestler or a boxer, outperform the opponent by holding one hand and striking using the other hand as fast as the opponent. The fighters must also possess various fighting skills such as distant fighting, ground fighting, etc.

Hence the present invention, rope tag fighting game, is designed to play a fighting game using only one hand while expressing the martial art skill of the fighters.

SUMMARY OF THE INVENTION

This summary is provided to introduce a selection of concepts in a simplified form that are further disclosed in the detailed description of the invention. This summary is not intended to determine the scope of the claimed subject matter.

According to an exemplary embodiment of the present invention, a method of playing rope tag fighting game involves holding a rope by two fighters, wherein each of the fighters can hold the rope using any of the two hands and the other hand of each of the fighters is left free, playing a first-round of game, wherein playing the first-round comprising striking a fighter by another fighter using the free hand and vice versa while holding the rope, deciding the winner of the first-round, wherein the winner of the first-round is the fighter that did not lose the rope while striking each other, deciding, by the winner of the first-round, which hands of two fighters to hold the rope prior to begin the second-round, using the wrestling or kick boxing skills of both fighters to win the second-round, if the free hand of loosing or the winning fighters is non-dominant, deciding the winner of the second-round, wherein the winner of the second-round is the fighter that did not lose the rope while striking each other, holding the rope, for third-round, using free hands of second-round, using the wrestling or kick boxing skills of both fighters to win the third-round, if the free hand of loosing or the winning fighters is non-dominant and deciding the winner of the game by choosing best player of the three rounds.

BRIEF DESCRIPTION OF THE DRAWINGS

The present invention will become clearly understood to those of ordinary skill in the art when descriptions of exemplary embodiments thereof are read with reference to the accompanying drawings.

DETAILED DESCRIPTION OF THE INVENTION

Rope tag fighting is a combat physical contact sport which is being played by two fighters holding one rope using one hand. Each fighter is attached to one another using a rope that is around 20 inches of length, wherein one fighter holds one end of the rope and the other fighter holds the opposite end of the rope as shown in FIG. 1

To ensure that every fighter would train almost perfectly balanced and logically force to use both striking and ground fighting technique, three rounds is purposely designed. The rope tag fighting game may be played more than 15 minutes on the floor which satisfies the expectation of viewers. The referee may allow both the fighters to rest not more than one minute in between each round.

Figure 1:
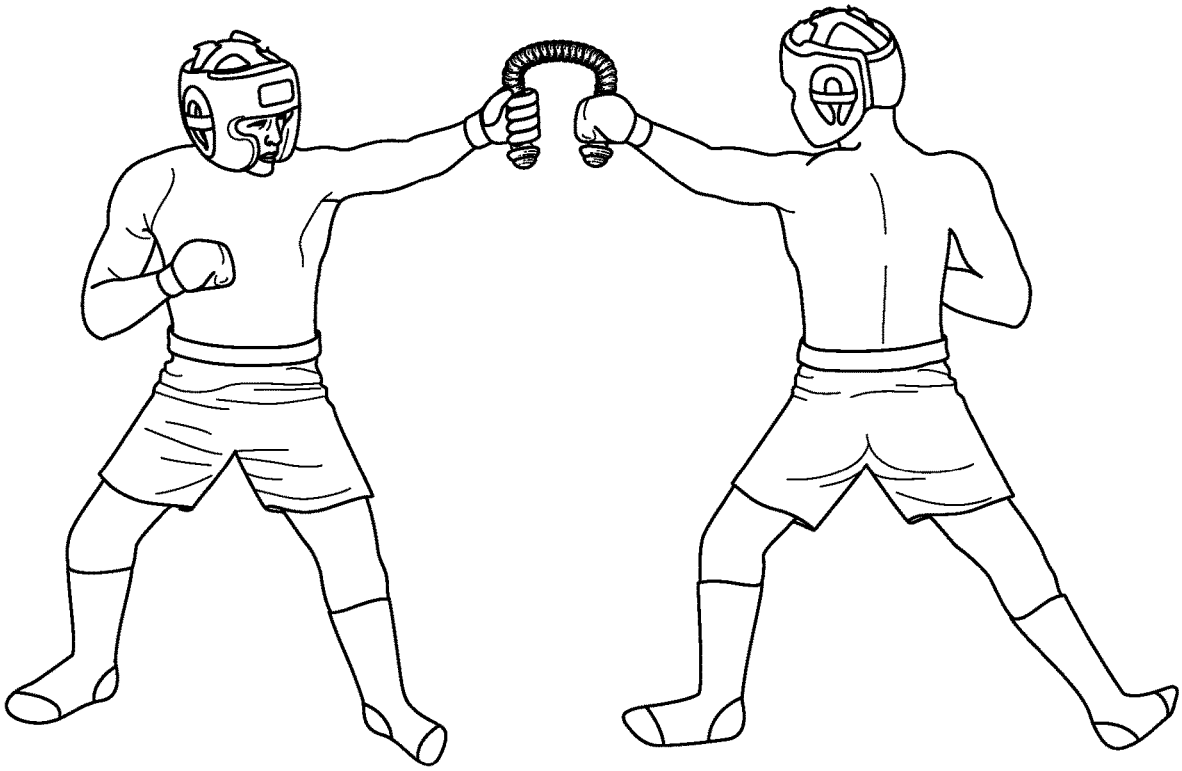
FIG. 1 illustrates fighters playing rope tag fighting game in first-round.

A method of playing rope tag fighting game involves holding a rope by two fighters as shown in FIG. 1, wherein each of the fighters can hold the rope using one of the two hands and the other hand of each of the fighters must be left free. The method further involves playing a first-round of game, wherein playing first-round comprising striking a fighter by opponent fighter using the free hand and vice versa while holding the rope. As a result of strike by the fighters, the winner of the first-round shall be decided. Wherein the winner of the first-round is the fighter that did not lose the rope while striking the opponent.

The winner of the first-round must decide which hands of the two fighters should hold the rope prior to begin the second-round. The fighters shall use wrestling or kick boxing skills to win the second-round, if the free hand of loosing or the winning fighters is non-dominant. The winner of the second-round shall be decided, wherein the winner of the second-round is the fighter that did not lose the rope while striking each other.

The fighters' hands which were not holding the rope in second-round must hold the rope in third-round. Both the fighters should use the wrestling or kick boxing skills to win the third-round, if the free hand of loosing or the winning fighters is non-dominant. The winner of the game is decided by choosing best fighter of the three rounds. Wherein, the third-round shall be a tie breaker.

Figure 2:
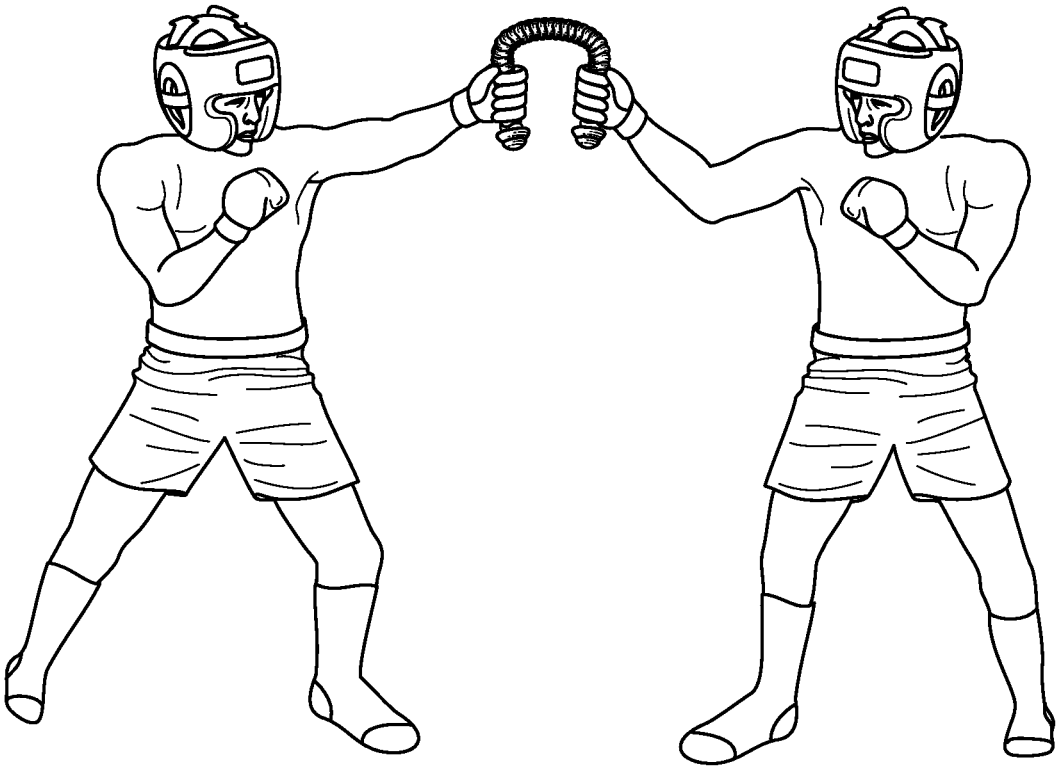
FIG. 2 illustrates fighters playing rope tag fighting game in second-round.
Figure 3:
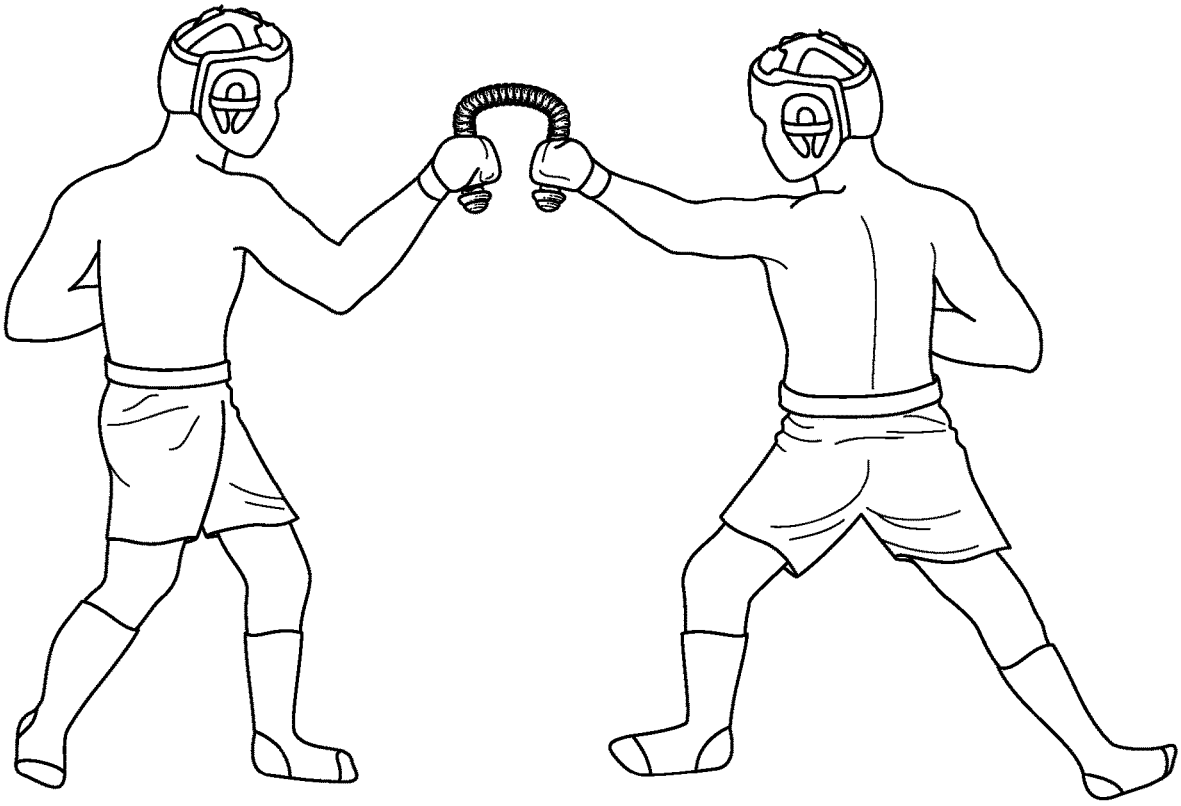
FIG. 3 illustrates fighters playing rope tag fighting game in third-round

For example, in FIG. 1, the fighters started playing the rope tag fighting game by holding the rope using left hands. FIG. 2 shows the fighters holding rope in second-round, assuming that the fighter in the left side wins and decided to hold the rope using left hand and to hold the rope using right hand by the fighter in the right side. And in FIG. 3, assuming the fighter in the right-side wins but the rule is to hold the rope, in third-round, using hands which were used in striking the opponent in second-round.

The fighters shall tap in order to indicate the willingness to quit from the game. The referee stoppage shall be considered to indicate that at least one of the fighters can no longer perform the rule of winning and considered as technical knockout (TKO).

The step of striking a fighter by another fighter comprises no illegal contact such as headbutts, choking or poking using fingers, groin hit, biting, hair pulling, using both hands to hold the rope, or using the free hand for extra grip on the rope.

This sport can be a conducted as tournament, a championship, a league or a match. Also, the number of participants can be of 2, 4, 8, 16, 32, 64 or more in each weight division or class, based upon the event organizers. There is no point system for the strikes. Winner would gain one point per round. Time limit for each round shall be decided based on the type of the sport.

The foregoing example has been provided merely for explanation and are in no way to be construed as limiting of the method disclosed herein. It is understood that the invention has been described above may be made with many changes and modifications without departing from the scope of the invention. It is also intended that the detailed description of the present invention be regarded as illustrated rather than limiting, and following claims are intended to define the scope of present invention.

I claim:

1. A method of playing rope tag fighting game, the method comprising:

holding a rope by two fighters, wherein each of the fighters holds the rope using one of two hands and the other hand of each of the fighters is left free;

playing a first-round of game, wherein playing the first-round comprising striking a fighter by an opponent fighter of the two fighters using the free hand and vice versa while holding the rope;

deciding a winner of the first-round, wherein the winner of the first-round is the fighter that did not lose the rope while striking each other;

deciding, by the winner of the first-round, which hands of the two fighters to hold the rope prior to beginning a second-round;

using wrestling or kick boxing skills of both fighters to win the second-round, if the free hand of the loosing or the winning fighters is non-dominant;

deciding a winner of the second-round, wherein the winner of the second-round is the fighter that did not lose the rope while striking each other;

holding the rope, for a third-round, using the free hands of the second-round;

using the wrestling or kick boxing skills of both fighters to win the third-round, if the free hand of the loosing or the winning fighters is non-dominant; and deciding a winner of the game by choosing best fighter of the three rounds.

2. The method of claim 1, further comprising tapping by at least one of the fighters to indicate quitting the game.

3. The method of claim 1, further comprising a referee stoppage to indicate that at least one of the fighters can no longer perform a rule of winning and considered as technical knockout (TKO).

4. The method of claim 1, wherein striking a fighter by an opponent fighter comprises no illegal contact such as headbutts, choking or poking using fingers, groin hit, biting, hair pulling, using both hands to hold the rope, or using the free hand for extra grip on the rope.

5. The method of claim 1, wherein the third-round shall be a tie-breaker.

6. The method of claim 1, wherein deciding the winner of the game by choosing best fighter of the three rounds comprises choosing the winner having most wins among all three rounds.

* * * * *